US011305576B2

(12) United States Patent
Gagnon et al.

(10) Patent No.: US 11,305,576 B2
(45) Date of Patent: Apr. 19, 2022

(54) MULTI PEN DRY ERASE MARKER

(71) Applicants: Roger Henry Gagnon, Great River, NY (US); William Juan Calvo, Port Jefferson Station, NY (US); Steve Butcher, Bristol, RI (US)

(72) Inventors: Roger Henry Gagnon, Great River, NY (US); William Juan Calvo, Port Jefferson Station, NY (US); Steve Butcher, Bristol, RI (US)

( * ) Notice: Subject to any disclaimer, the term of this patent is extended or adjusted under 35 U.S.C. 154(b) by 123 days.

(21) Appl. No.: 16/586,601

(22) Filed: Sep. 27, 2019

(65) Prior Publication Data

US 2021/0094339 A1 Apr. 1, 2021

(51) Int. Cl.

| | |
|---|---|
| ***B43K 24/16*** | (2006.01) |
| ***B43K 23/08*** | (2006.01) |
| *B43K 8/02* | (2006.01) |
| *B43K 29/05* | (2006.01) |

(52) U.S. Cl.

CPC ..... *B43K 24/163* (2013.01); *B43K 23/08* (2013.01); *B43K 8/022* (2013.01); *B43K 29/05* (2013.01)

(58) Field of Classification Search

CPC ..... B43K 23/08; B43K 24/082; B43K 24/16; B43K 24/163

See application file for complete search history.

(56) References Cited

U.S. PATENT DOCUMENTS

| | | | | | |
|---|---|---|---|---|---|
| 1,281,223 | A * | 10/1918 | Stepanchak | A45D 40/02 | 401/81 |
| 1,937,157 | A * | 11/1933 | Lee | A45D 40/02 | 401/81 |
| 2,303,273 | A * | 11/1942 | Hendrick | B43K 23/00 | 401/81 |
| 3,174,462 | A * | 3/1965 | Bross | B43K 24/16 | 401/33 |
| 3,288,116 | A | 11/1966 | Poritz | | |
| 10,507,687 | B1 * | 12/2019 | Hill, III | B43K 24/163 | |
| 2014/0023423 | A1 * | 1/2014 | Branch | B43K 8/24 | 401/23 |
| 2019/0039404 | A1 * | 2/2019 | Cunningham | B43K 24/163 | |
| 2019/0366756 | A1 * | 12/2019 | Michenaud | B43K 24/146 | |

FOREIGN PATENT DOCUMENTS

| | | | |
|---|---|---|---|
| KR | 20170077375 | A * | 7/2017 |
| KR | 101849221 | B1 * | 4/2018 |

* cited by examiner

*Primary Examiner* — David P Angwin
*Assistant Examiner* — Bradley S Oliver

(57) ABSTRACT

The multi pen dry erase marker consists of two to six color dry erase pens that are spring loaded into an ergonomic housing and designed to be used with one hand only. Changing of colors is easy to do by pushing a button to add a pen color. To remove a color the pen is pushed back into the housing which locks it back in place. The end cap of the marker has a large felt or sponge tip to easily erase using a standard whiteboard. A storage cap protects the pens from drying out when being stored.

2 Claims, 4 Drawing Sheets

MULTI PEN DRY ERASE MARKER

CROSS REFERENCES TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION BY REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR A JOINT INVENTOR

Not Applicable

FIELD OF THE INVENTION

The present invention relates to the field of dry erase markers and more particularly to a novel dry erase marker that contains a plurality of dry erase pens that can be quickly changed while writing.

BACKGROUND OF THE INVENTION

One of the first adaptations to including multiple colors in a writing instrument was adapted for use in ball point pens. U.S. Pat. No. 3,288,116 entitled "Multi-Color Adapted Ball Point Pen" was issued to inventor Nathan Poritz in 1966. That invention was widely used in the ball point pen industry but has not until now been considered for use in dry erase markers. Today's dry erase markers come in a large variety of colors but yet there exist no dry erase markers sold today that have been adapted for multiple color pens. The present invention will now describe a novel adaptation of multiple colors for use in dry erase markers.

BRIEF SUMMARY OF THE INVENTION

It is a first object of the present invention to provide a dry erase marker that allows for use of at least four separate colors.

It is a second object of the present invention to provide a dry erase marker that has improved ergonomic design features that allow one to write in a natural position.

BRIEF DESCRIPTION OF THE INVENTION

FIG. 4 is a perspective view of the grovel dry erase multi-pen marker of the present invention shown with all pens retracted and with the end cap on.

DETAILED DESCRIPTION OF THE INVENTION

Figure 1:
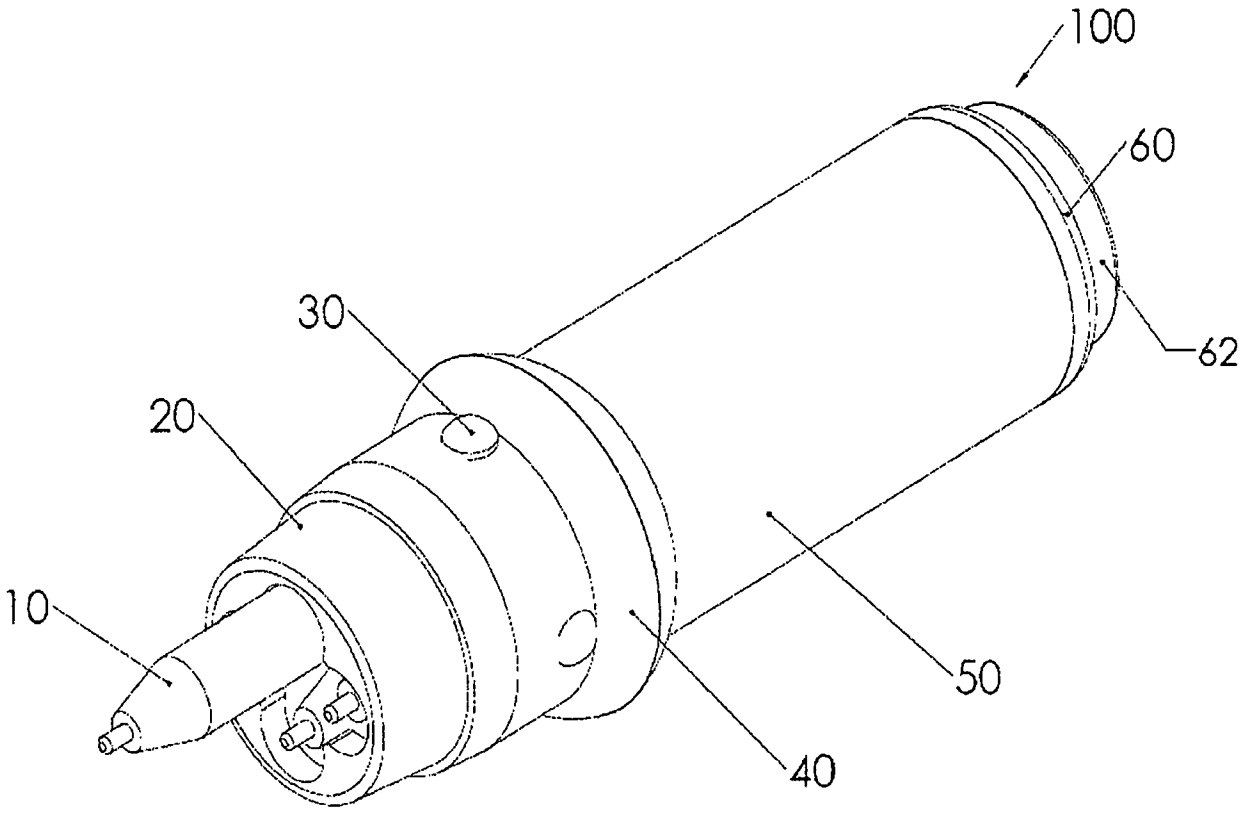
FIG. 1 is a perspective view of the novel dry erase multi-pen marker of the present invention shown with one pen extended and with the end cap removed.
Figure 2:
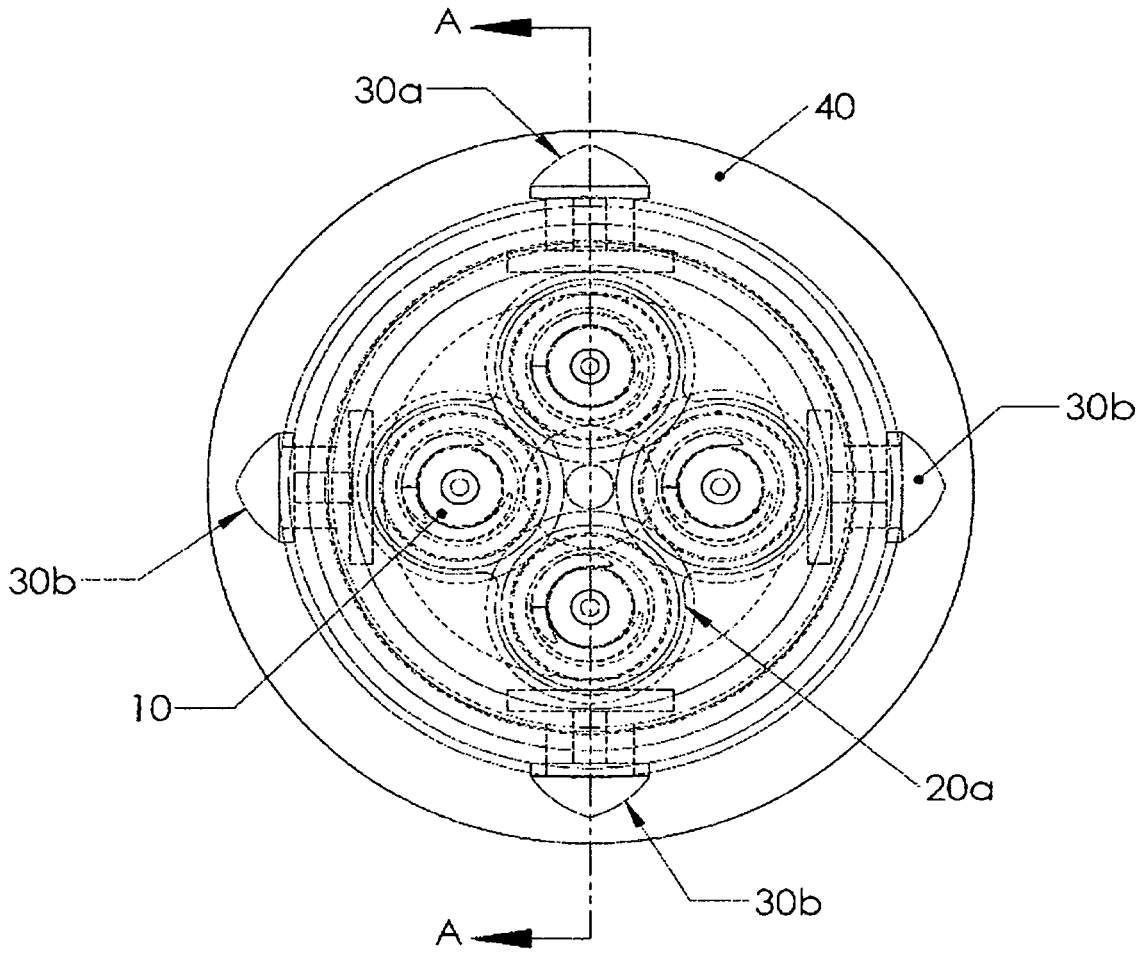
FIG. 2 is a front view of the marker

Referring first to FIGS. 1 and 2, a dry erase multi-color marker 100 is shown with a dry erase marker 10 extended beyond the front of housing 20. In the preferred embodiment, there are four dry erase markers 10, each marker having a different color ink. When a pen is needed, a push button extension mechanism 30 is depressed. The mechanism is not shown in detail here as it is already widely used in prior art click pens to extend or retract the pen using a spring-loaded plunger. In the present embodiment, the push button mechanism 30 is only used as a pen extension means in the present invention. A pair of assembly rings 40 are used during manufacturing to connect the front housing 20 to the rear housing 50. An end cap 60 is then assembled to the rear housing 50.

Figure 3:
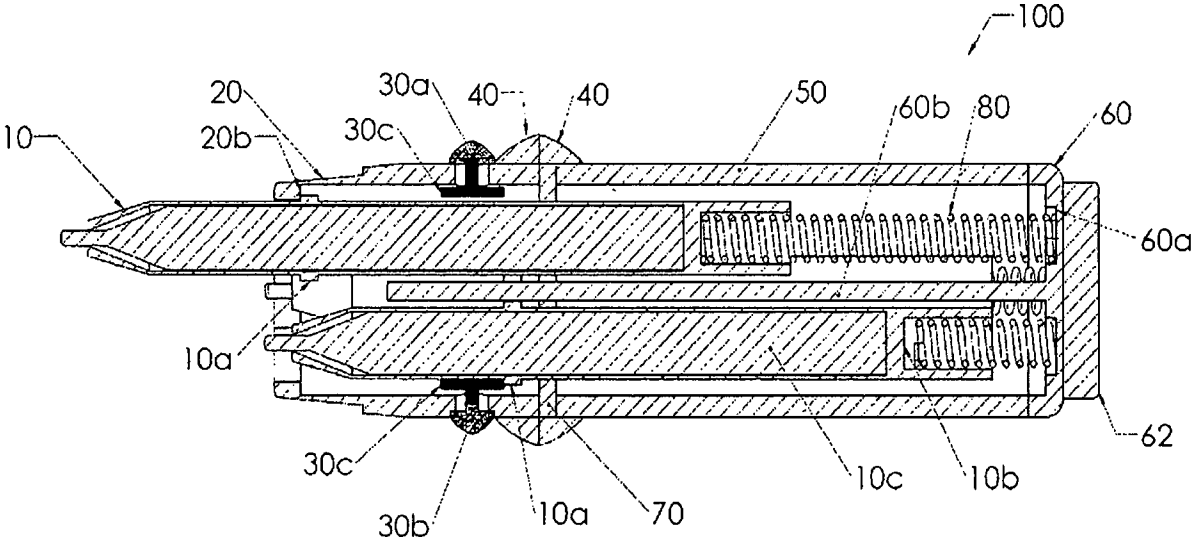
FIG. 3 is a sectional view of the marker taken along line A-A of FIG. 2.

Referring next to FIGS. 2 and 3, the internal workings of the multi-color dry erase marker 100 are next explained. The push button mechanism 30 is shown in two different states. In the retracted state (30*a*), the plunger 30*c* has been moved outward such that it rests of the interior wall of housing 20. This allows a rear mounted spring 80 to push the marker pen forward until it locks into place by contact between the front face of marker collar 10*a* against the interior wall 20*b* of housing 20. The remaining three pens shown are in storage state and are kept in place by contact between the front face of marker collar 10*a* against the plunger 30*c* of extended push button mechanisms 30*b*. To retract the pen, the tip of marker 10 is pushed against a hard surface and the push button mechanism for that pen is depressed causing the plunger to lock the pen in place as previously explained. In the preferred embodiment there is a dry felt or sponge eraser 62 rigidly attached to rear face of the end cap 60. This is needed because the individual marker pens have no means to erase ink from the writing surface.

Referring now to only FIG. 2, the remaining specifications are finally explained. A locating ring 70 is inserted between the front and rear housings and has 4 apertures concentrically spaced at 90 degrees apart for the preferred embodiment of a tour-color marker. The apertures are tolerance such that they keep the marker housings from twisting inside the marker so as to prevent jamming of the markers. Each marker also has a blind hole 10*b* which allows the spring 80 to be centered for purposes of maintaining proper location of the markers. There is also a center guide rod 60*b* attached to end cap 60 which prevents the markers from tilting inwards. The springs also are kept in place using pockets 60*a* located on the interior wall of end cap 60.

Figure 4:
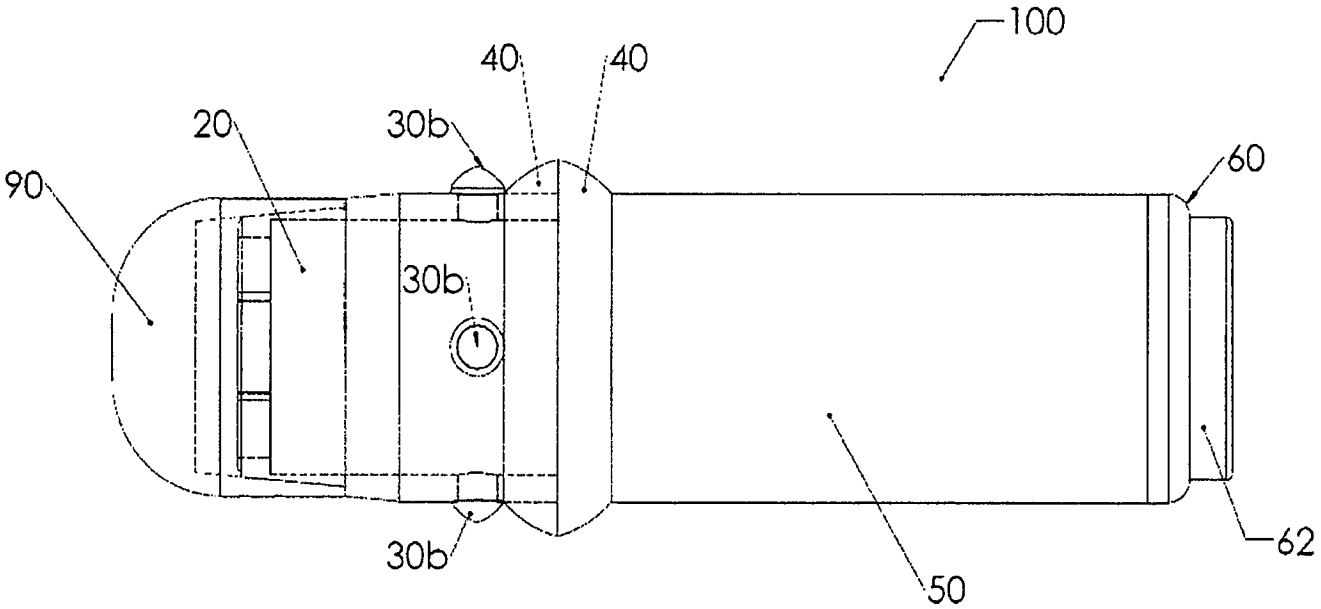

Referring finally to FIG. 4, the multi-color dry erase marker 100 is shown with all markers retracted. When the marker is to be stored, a storage cap 90 is placed over the front housing 20 as shown. Using a storage cap is important to prevent drying out of the marker ink wetted fibers 10*c*. Although not shown, alternative end cap 60 embodiments may include a tapered groove so that the cap 60 can be mounted on the rear of marker 100 when in use as is common with single dry erase marker pens.

What is claimed is:

1. A dry erase marker comprising:

A) a front housing, said front housing being of a tapered conical shape having a front aperture for allowance of a plurality of dry erase pens to pass through; said front housing further containing a plurality of circular holes equally spaced and completely passing thru a wall of said front housing; said front housing further containing a tapered cut at the front distal end of said front housing;

B) a rear housing, said rear housing being of a cylindrical shape and having an outside diameter of the same diameter of said front housing;

C) an end cap, said end cap having a disc shape and having an outside diameter of the same diameter of said rear housing; said end cap being rigidly attached to a rear face of said rear housing; said end cap also having a long rod extending from the interior center wall of said end cap and ending approximately halfway into the interior of said front housing; said end cap also containing a dry erase ink eraser, said eraser being rigidly attached to the rear surface of said end cap;

D) a pair of rings, said rings being of a circular shape and being rigidly attached together as well as being rigidly attached to both said front and rear housings; said rings being of a soft material to provide a means for gripping said dry erase marker;

E) a plurality of dry erase pens, said pens having a cylindrical housing and an internal fibrous material containing a dry erase ink; said cylindrical housing of said dry erase pen having a blind hole at the distal end opposite of a writing tip of said dry erase pen; said cylindrical housing of said dry erase pen further containing a circular flange, said flange located approximately two thirds of the overall length between said distal ends of said housing and being closer to said distal end containing said pen tip;

F) a plurality of push button mechanisms, said mechanism to provide a means for release or extension of a single dry erase pen upon activation of said mechanism; said mechanism to provide the means of extension or retraction of a plunger; each of said push button mechanisms being in contact with each of said outside face of said circular flange when said mechanism is in the extended position;

G) a plurality of springs, each spring being located concentric to each of said dry erase pens; said front end of said spring pressing against an interior wall of said blind hole of said thy erase pen; said rear of spring pressing against said interior wall of said end cap;

H) a locating ring, said locating ring being rigidly attached between rear face of said front housing and front face of said rear housing; said locating ring having a plurality of circular holes, said circular holes having a diameter slightly larger than said dry erase pens; said locating ring also containing a center hole of a slightly larger diameter than said elongated rod of said end cap; and I) a storage cap, said storage cap being of a conical shape with a blunt nose.

2. The dry erase marker of claim 1, whereas said end cap has a tapered elongated protrusion at the exterior face of said end cap; said elongated tapered protrusion providing a means of removable attachment to an interior tapered face of said storage cap.

* * * * *